United States Patent [19]

Hilton et al.

[11] Patent Number: 4,934,596

[45] Date of Patent: Jun. 19, 1990

[54] SLURRY DISTRIBUTOR

[75] Inventors: Dennis M. Hilton, Londonderry, N.H.; Mary E. Driscoll, Arlington, Mass.

[73] Assignee: W. R. Grace & Co.-Conn., New York, N.Y.

[21] Appl. No.: 299,043

[22] Filed: Jan. 19, 1989

[51] Int. Cl.[5] ..... B05B 7/06

[52] U.S. Cl. ..... 239/8; 239/428; 239/416.5; 239/419.3; 239/432

[58] Field of Search ..... 366/3, 10, 11, 336, 366/339; 106/90; 239/336, 9, 422, 432, 433, 419, 419.3, 419.5, 428.8, 425.5, 416.5

[56] References Cited

U.S. PATENT DOCUMENTS

| | | | |
|---|---|---|---|
| 1,844,662 | 2/1932 | King . | |
| 1,941,726 | 1/1934 | Vawter | 366/11 X |
| 1,952,691 | 3/1934 | Coxon | 106/34 |
| 2,017,022 | 10/1935 | Roos | 106/24 |
| 2,025,974 | 12/1935 | Fritz | 239/431 X |
| 2,075,867 | 4/1937 | Sampel | 366/11 |
| 2,216,555 | 10/1940 | King et al. | 106/34 |
| 2,364,344 | 12/1944 | Connell et al. | 106/86 |
| 3,035,940 | 5/1962 | Hobson | 117/104 |
| 3,077,415 | 2/1963 | Ayres | 239/9 X |
| 3,369,929 | 9/1962 | Petersen | 117/127 |
| 3,719,513 | 3/1973 | Bragg et al. | 106/114 |
| 3,839,059 | 10/1974 | Rothfelder et al. | 106/115 |
| 3,929,692 | 12/1975 | Offerman | 260/7.5 |
| 4,075,374 | 2/1978 | Jorgenson et al. | 106/90 X |
| 4,095,748 | 6/1978 | Ohtake et al. | 239/419.3 |
| 4,306,395 | 12/1981 | Carpenter | 52/223 R |
| 4,339,078 | 7/1982 | Ford et al. | 366/336 X |
| 4,618,294 | 10/1986 | Brown | 366/10 X |
| 4,721,659 | 1/1988 | Tieckelmann et al. | 428/701 |
| 4,751,024 | 6/1988 | Shu et al. | 252/601 |
| 4,772,327 | 9/1988 | Allermann et al. | 106/90 |

OTHER PUBLICATIONS

Brochure entitled "Essick Model TW—8 E-Z--Coater", (undated) published by Essick Manufacturing Company.

Brochure entitled "Essick TW—8 E-Z Coater Plaster and Finish Machine", (undated) published by Essick Manufacturing Company.

*Primary Examiner*—Andres Kashnikow
*Assistant Examiner*—Kevin P. Weldon
*Attorney, Agent, or Firm*—Kevin S. Lemack; William L. Baker

[57] ABSTRACT

A slurry distributor (S) for distributing a low viscosity fluid into a viscous, hydraulic slurry comprises a main conduit (1) located on a first axis $\alpha$ for conducting a flowing, viscous, hydraulic slurry towards an orifice (3). The distributor (S) has an air injector (5) defined by a stem (7) located on a second axis $\beta$. The air injector (5) is for introducing air into the slurry to disperse it from the orifice (3). A second injector (9) located on a third axis $\gamma$ and intersecting the main conduit (1) is used to introduce a low viscosity liquid, preferably an accelerator, into the flowing slurry such that the low viscosity liquid impinges on the air injector stem (7) before dispersion. The distributor is especially useful with fireproofing compositions since it provides effective distribution of a viscous, hydraulic, cementitious slurry with an acidic accelerator.

37 Claims, 2 Drawing Sheets

SLURRY DISTRIBUTOR

FIELD OF THE INVENTION

The present invention relates to a slurry distributor for use with viscous hydraulic slurries having a low viscosity fluid introduced therein.

BACKGROUND OF THE INVENTION

It is well known to spray apply cementitious slurries on to metal structural members to provide a heat resistant coating. A particularly successful type of product in this field is a gypsum-based formulation which contains, in addition to the gypsum binder, a lightweight aggregate, a fibrous substance. e.g. cellulose and an air entraining agent. See U.S. Pat. Nos. 3,719,513 and 3,839,059. When applying a heat resistant coating on a metal structural member, the slurries used are generally prepared at ground level and pumped to the point of application. The point of application can exceed 20 to 30 stories in high rise construction and the slurry is generally applied through a spray nozzle.

Slurries must possess a number of important properties to be suitable as heat resistant coatings and some examples of these important properties are set forth below. First, they must be sufficiently fluid to be pumped easily and to great heights. Second, they must retain a consistency sufficient to prevent segregation or settling of ingredients and provide an adequate "yield" or volume of applied fireproofing per weight of dry mix Third, they must adhere to the metal the structural member is comprised of, both in the slurried state and after setting. Fourth, the slurry must set without undue expansion or shrinkage which could result in the formation of cracks that can deter from the insulative value of the coating.

A further factor which affects the formulation of the hydraulic cementitious compositions is set time. Fireproofing mixes, such as W.R. Grace & Co.-Conn.'s MONOKOTE® brand materials, are transported to the building site as dry mixtures and in a mixer an appropriate amount of water is added to form a slurry. The slurry is pumped from temporary holding equipment to the point of application. The preparation and application processes may span many hours and thus the setting time of the mix is generally heavily retarded to provide an acceptable field pot life. If the accelerators are introduced in the mixer, problems arise if the operation is suspended, as premature set-up occurs. Set-up is the hardening of the slurry composition. Similarly, where the components are pumped over distances, premature set-up can occur prior to reaching the final destination.

Although the addition of retarders provides a mix which remains pumpable over many hours, this long set time is undesirable once the composition has been applied to the structure. If applied under hot, dry conditions, the mix may dehydrate before setting and yield a less than optimum final product. In cold temperatures, the mix may freeze before setting, while the preferred sequence is setting before freezing. Where multiple layers of fireproofing are to be applied, the first layer must set at least partially prior to application of the next layer. The long set time thus requires the sprayman to move on to another portion of the structure, only to return several hours later for application of the next layer. This results in an inefficient use of manpower.

Prior to spraying the viscous hydraulic slurry, accelerators are sometimes added to the slurry to decrease the total set-time. Mixing problems are encountered when the accelerators are added to the slurry since the slurry is a very viscous substance (in the case of a cementitious slurry, the apparent viscosity is about 13000 cp) and the accelerator is a low viscosity liquid (in the case of aluminum sulfate, the viscosity is about 3 cp). The viscous hydraulic slurry flows as a plug (i.e., plug flow) with minimal or no turbulence and it is difficult to obtain mixing between the viscous slurry plug and the low viscosity accelerator being introduced into the flow path of the slurry. This difficulty is compounded by the fact that only a small amount of low viscosity liquid is used with a relatively large amount of high viscosity slurry, and the fact that the flow rate of the slurry is such that its residence time in the distributor is only about 0.1 seconds. Various attempts have been made to mix the accelerator and slurry.

The accelerator has been injected directly into the middle of the slurry upstream from the air injector which is used to dispense the viscous slurry. The set time for the viscous slurry was not consistent throughout the entire spray pattern and therefore was unsatisfactory.

SUMMARY OF THE INVENTION

The aforementioned problems of the prior art have been overcome by the present invention, which provides a method for and apparatus capable of substantially evenly dispersing a relatively high viscosity slurry with a relatively low viscosity fluid.

The slurry is received by a distributor so that it flows toward a dispersing point, such as a dispensing orifice. The present inventors have found that upon introduction of the relatively low viscosity fluid into the high viscosity slurry flow path instead of mixing with the slurry, the low viscosity fluid tends to flow toward a wall of the distributor. Means is then provided to direct and position the low viscosity fluid so that it may be substantially evenly dispersed with the slurry. The means to direct and position the low viscosity fluid may be a member which is positioned in the distributor to intercept the flowing low viscosity fluid and direct and position it appropriately relative to the slurry so that upon dispersion, the slurry and low viscosity fluid are substantially evenly dispersed. The dispersion is accomplished by introduction of a gas, preferably air, in proximity to the dispensing orifice. An air injector may be used.

The invention resides in an apparatus for dispersing materials comprising a conduit means having an orifice and a first means for receiving a flowing slurry into the conduit means. The distributor also comprises a second means for introducing liquid into the conduit means at a point downstream from the first means relative to the direction of flow and a third means for directing the liquid toward the orifice. The third means being located at a point downstream from the first means relative to the direction of flow and being disposed in the conduit means such that the liquid contacts the third means and is directed toward the orifice so that it can be substantially evenly dispersed within the slurry The apparatus also comprises a fourth means for introducing a gas into the conduit means for dispersing the slurry and the liquid from the orifice.

In one embodiment, the invention resides in a distributor for low viscosity fluids into viscous, hydraulic slurries comprising a main conduit located on a first axis for conducting a flowing, viscous hydraulic slurry toward an orifice. The distributor is especially adapted for a cementitious slurry. The distributor also has an air injector defined by a stem located on a second axis which intersects the main conduit and an orifice for introducing air into the viscous, hydraulic slurry to disperse it from the orifice. The distributor has a second means located on a third axis which intersects the main conduit. The second means is located upstream, relative to the direction of flow, from the orifice for introducing low viscosity fluid into the flowing slurry before the dispersing air has been introduced. The low viscosity fluid is preferably an accelerator.

The low viscosity fluid is introduced so that it impinges on the air injector stem before dispersion. This can be done by injecting the low viscosity fluid with the third axis aligned towards the second axis or by injecting the air and low viscosity fluid into the slurry with the second and third axes substantially co-planar with each other and the first axis.

The present invention also encompasses a method for distributing low viscosity fluid into viscous, hydraulic slurries comprising directing a viscous, hydraulic slurry along a flow path to a distribution point. Air is introduced into the flow path of the slurry through an air injector stem, for example, which intersects the flow path of the viscous, hydraulic slurry. A low viscosity fluid is introduced into the flow path of the viscous hydraulic slurry directed along an axis which intersects the flow path and impinges the low viscosity fluid onto the air injector stem before the slurry reaches the distribution point. One way this can be accomplished is by introducing the low viscosity fluid into the flow path directed along a third axis which is substantially co-planar with the first and second axis. Another way this can be accomplished is by introducing the low viscosity fluid into the flow path directed along an axis which intersects the flow path and impinges the low viscosity fluid onto the injector stem before the slurry reaches the distribution point.

It is therefore an object of the present invention to provide an apparatus for dispersing materials.

It is a further object of the present invention to provide an apparatus for substantially evenly dispersing materials differing significantly in viscosities.

A still further object of the present invention is to provide an apparatus having means for directing a low viscosity fluid to a position where it can be substantially evenly dispersed with a high viscosity slurry.

It is another object of the present invention to provide a method of substantially evenly dispersing materials differing significantly in viscosities.

The above and other features of the invention including various novel details of construction in combinations of parts will now be more particularly described with reference to the accompanying drawings and pointed out in the claims. It will be understood that the particular slurry distributor and method for distributing a low viscosity liquid into a viscous slurry embodying this invention is shown by way of illustration only and not as a limitation of the invention. The principles and features of this invention may be employed in varied and numerous embodiments without departing from the scope of the invention.

DETAILED DESCRIPTION

Figure 1:
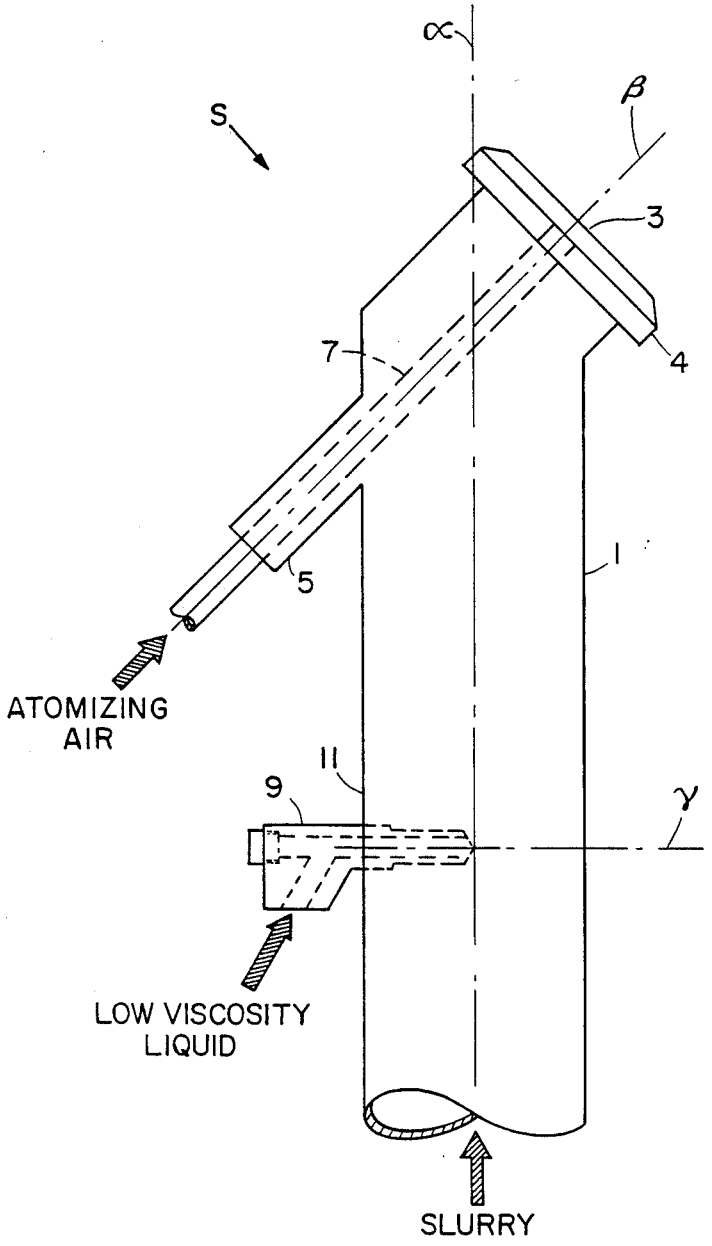
FIG. 1 shows a slurry distributor embodying the features of this invention wherein the axes of the main conduit, air injector stem and the low viscosity liquid injector are substantially co-planar in accordance with the present invention.

Referring to FIG. 1, a preferred embodiment of a slurry distributor S will be seen which comprises a main conduit 1 located on a first axis o for conducting a flowing, viscous hydraulic slurry toward an orifice 3. The distributor S further comprises an air injector 5 defined by a stem 7 located on a second axis $\beta$ intersecting the main conduit and aligned with the orifice 3. The air injector 5 is for introducing air into the distributor to disperse its contents from the orifice 3. A second means 9 in the form of a low viscosity liquid injector is located on a third axis $\gamma$ and intersect the main conduit 1. It is located upstream from the orifice 3, relative to the direction of flow, preferably about three inches to about six inches from the stem 7. The second injector means 9 is for introducing a low viscosity liquid into the flowing slurry before the dispersing air has been introduced. The low viscosity liquid is introduced into the slurry to impinge on the strategically located air injector stem 7 before dispersion.

One way of introducing the low viscosity liquid into the slurry so that it impinges on the air injector stem 7, is by constructing the distributor so that the first axis $\alpha$, second axis $\beta$ and the third axis o are substantially co-planar, preferably co-planar.

Figure 2:
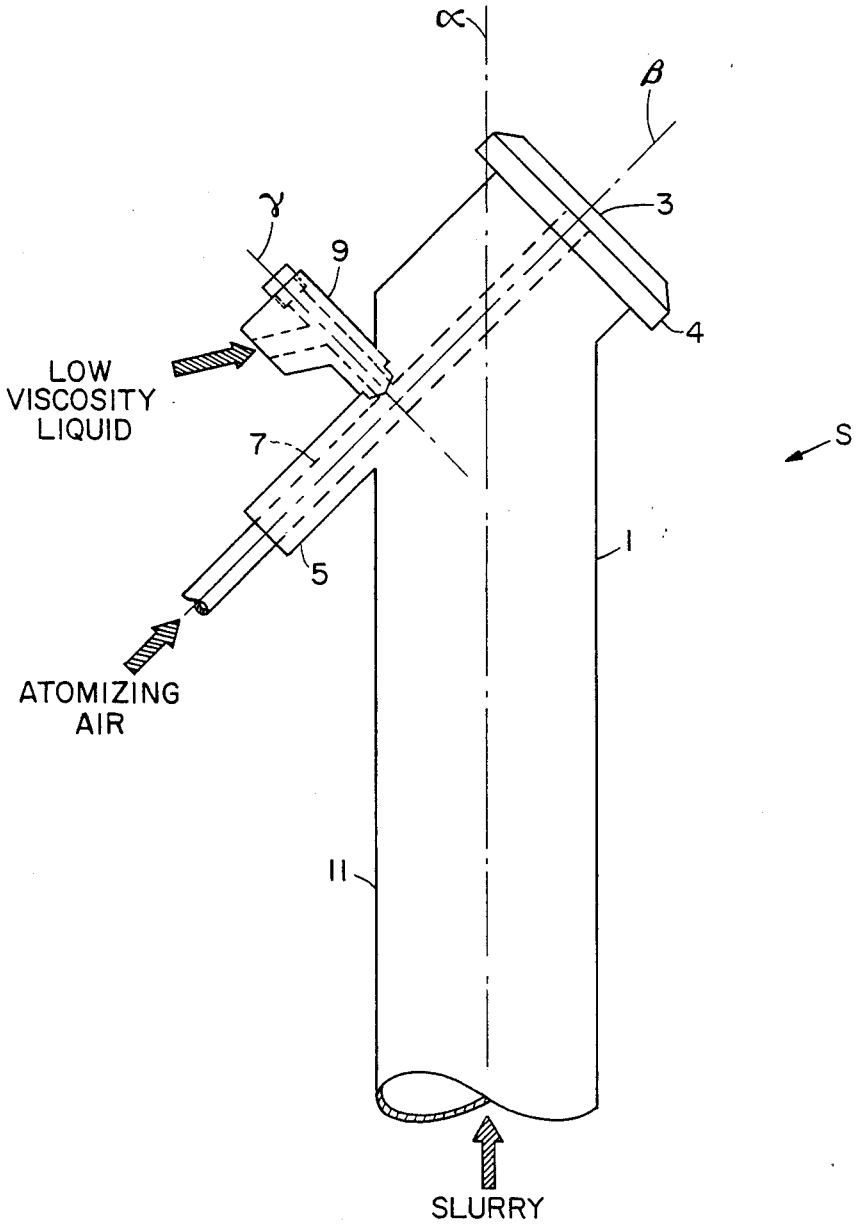
FIG. 2 shows the slurry distributor wherein the low viscosity liquid injected is positioned to direct the liquid towards the air stem.

A second embodiment of the slurry distributor S is depicted in FIG. 2. The second means 9 for injecting a low viscosity liquid into the slurry is directed towards the air injector stem so that the third axis $\gamma$ intersects the second axis $\beta$.

The distributor S can be made of any material capable of conducting a hydraulic, viscous slurry. Examples of such material are stainless steel aluminum The viscous, hydraulic slurry can be any viscous slurry such as a cementitious slurry or an asphalt based slurry. The preferred slurry is the fireproofing composition Monokote®; however, other useful slurries include gunite or stucco.

The main conduit 1 can have an inside diameter preferably from 1"to 1¼".

The air injector 5 is defined by a stem 7 located on a second axis $\beta$ which intersects the main conduit 1. The stem is movable lengthwise along the second axis $\beta$ relative to the nozzle 4. The stem has to intersect the main conduit 1 only to the extent necessary to serve as a target for the low viscosity liquid and to the extent necessary to provide atomization of the components for acceptable application.

Examples of the second means 9 for introducing the low viscosity liquid into the slurry are an orifice at the wall 11 of the conduit 1 or it can be an injector Where an injector is used as shown in FIG. 1, it is preferably flared at its discharge end . The low viscosity liquid can be introduced at the wall 11 of the conduit or any point along the air injector stem 7. Where the low viscosity liquid is introduced at the wall, penetration into the conduit of about 50% is preferred. Preferably, the second means 9 is located upstream from the orifice, relative to the direction of flow, and the axes $\alpha$, $\beta$, and $\gamma$ are substantially co-planar.

The preferred low viscosity fluid are accelerators which are added to the viscous slurry to decrease its set time upon a structure. Any acidic set accelerating agent capable of satisfactorily offsetting the retardation of the slurry can be used. For most commercial applications, the type and amount of accelerator is that which rapidly converts the setting time from about 4 to 12 hours to about 3.20 minutes. It is usually preferred to employ an accelerator in an amount which results in a setting time of about 5 to 10 minutes. The amount required to provide such setting times will vary depending on the accelerator and the type and amount of retarder and binder. Generally, an amount in the range of about 0.1% to 20% by weight of dry accelerator based upon the weight of dry fireproofing is used, with 2% being preferred. Examples of useful accelerators are aluminum sulfate, aluminum nitrate, ferric nitrate, ferric sulfate, ferric chloride, ferrous sulfate, potassium sulfate, sulfuric acid, and acetic acid. Aluminum sulfate is a preferred accelerator.

From the foregoing, it will be readily appreciated by those skilled in the art that the aforementioned mixing problems are circumvented by the apparatus and method of the present invention. Substantially even spray patterns have been achieved notwithstanding the significant viscosity differential between or among the materials to be dispersed.

Specifically, the location of the flowing low viscosity fluid is substantially in juxtaposition to a wall of the distributor. The directing and positioning means can therefore be appropriately located to intercept the stream and direct it toward the orifice so that it can be substantially evenly dispersed with the slurry. In the embodiment illustrated in FIG. 1, the means for directing and positioning the low viscosity fluid is the stem 7 of the air injector 5 which is strategically located to intercept the flowing low viscosity fluid. The low viscosity fluid then flows along the stem 7 and is thereby directed toward the orifice 3. The stem 7 is substantially centrally located with respect to the conduit 1 and therefore with respect to the flowing slurry, so that as the low viscosity fluid reaches the nozzle end of the air injector 5, it is appropriately positioned to be substantially evenly dispersed with the slurry to achieve an acceptable spray pattern. In another embodiment, the means for directing and positioning the low viscosity fluid is a member positioned in the flow path of the slurry, such as a metal rod.

As shown in FIG. 1, the main conduit 1 has an angled portion in which the orifice 3 is located. This configuration allows for easy spraying and also may aid in the distribution of the materials. An angle of 45° is preferred, although other configurations can be used without departing from the spirit and scope of the present invention. Where other configurations are used, it is important to position the means for directing the low viscosity fluid in the appropriate manner so that the low viscosity fluid can be substantially evenly dispersed with the slurry.

The slurry distributor is especially useful for the spraying of fireproofing compositions such as a Monokote® slurry with aluminum sulfate as an accelerator. The mixing problems encountered with Monokote% and the accelerator are common to any composition which requires the mixing of a viscous substance with a low viscosity liquid. Thus, the distributor encompassed by the present invention can be used effectively with any composition comprising more than one component differing significantly in viscosities.

The following examples further illustrate the present invention. In the examples, Monokote® was used as the viscous slurry and aluminum sulfate was used as the low viscosity fluid. The aluminum sulfate accelerator was added in an amount of 2% by weight of dry accelerator based upon the weight of dry fireproofing. A number of parameters were varied such as the diameter of the conduit, the angle between planes defined by $\beta$ and $\gamma$, and the location of accelerator introduction into the conduit. The effect of varying the various parameters was analyzed by measuring the percent set at 10 minutes and taking an average based on a plurality of trial runs. The percent set is representative of the percentage of the spray pattern which set within a ten minute time period. This was corroborated using a dye which emphasized the accelerator distribution throughout the spray pattern so it could be observed The results are shown in Table 1.

Examples 1–7

TABLE 1

| Location of Accelerator Introduction (expressed as a % of the total conduit diameter) | Conduit Diameter (inches) | Angle Between Planes Defined by $\beta$ and $\gamma$ | Average % Set at 10 Minutes |
|---|---|---|---|
| 1. 0 (at conduit wall) | 1 | 0 (coplanar) | 85 |
| 2. 50 | 1 | 0 (coplanar) | 100 |
| 3. 60 | 1 | 0 (coplanar) | 90–95 |
| 4. 50 | 1.25 | 0 (coplanar) | 95 |
| 5. 60 | 1 | 0 (coplanar) | 90* |
| 6. 50 | 1 | 180 (coplanar) | 90 |
| 7. 50 | 1 | 90 | 50–60 |

*In this run, the distance between the alum injector was increased by 12 inches

Examples 8–12

Table 2 shows the results obtained when the accelerator is injected at a point upstream from the air stem (trial runs 1 and 2) as compared with the accelerator being injected approximately onto the air stem (trial runs 3–5).

TABLE 2

| Low Viscosity Fluid Injector Description | Conduit Diameter | Angle with Respect to Air Stream | Average % Set at 10 Minutes |
|---|---|---|---|
| 1. upstream from air stem | 1.25 | 0 | 95–100 |
| 2. upstream from air stem | 1 | 0 | 95–100 |
| 3. injector tube almost touching air stem | 1.25 | — | 95 |
| 4. injector tube approx. ⅛" from the air stem | 1.25 | — | 95–100 |
| 5. injector tube approx. ⅛" from air stem offset approx. 10°–15° | 1.25 | — | 70–85 |

We claim:

1. An apparatus for dispersing materials, comprising: conduit means having an orifice;

first means for receiving a flowing slurry into said conduit means;

second means for introducing fluid into said conduit means at a point downstream from said first means relative to the direction of flow;

third means having an outer surface for directing said fluid toward said orifice, said third means being located at a point downstream from said first means relative to the direction of flow and being disposed in said conduit means such that said fluid contacts and flows along said outer surface and is thereby directed toward said orifice so that it can be substantially evenly dispersed with said slurry; and fourth means for introducing a gas into said conduit means for dispersing said slurry and said fluid from said orifice.

2. An apparatus for dispersing materials according to claim 1, wherein the second means for introducing a fluid into said conduit means is an injector.

3. An apparatus for dispersing materials according to claim 1, wherein the second means for introducing a fluid into a conduit means is an orifice at the wall of the conduit means.

4. An apparatus for dispersing materials according to claim 1, wherein the third means is an air stem.

5. An apparatus for dispersing materials according to claim 1, wherein the third means is a member positioned in the flowpath of the slurry.

6. An apparatus for dispersing materials, comprising:

conduit means having a surface and an orifice;

first means for receiving a viscous flowing slurry into said conduit means, said slurry moving in substantially laminar plug flow;

second means for introducing fluid into said conduit means at a point downstream from said first means relative to the direction of flow, said fluid having a low viscosity relative to said slurry and thereby having a tendency to travel substantially in juxtaposition to said surface of said conduit means;

third means for directing said fluid toward said orifice, said third means being located at a point downstream from said first means relative to the direction of flow and being disposed in said conduit means such that a substantial portion of said fluid traveling substantially in juxtaposition to said surface of said conduit means contacts said third means and travels substantially in juxtaposition to it and is thereby directed toward said orifice so that it is positioned to be substantially evenly dispersed within said slurry; and fourth means for introducing a gas into said conduit means for dispersing said slurry and said fluid from said orifice.

7. An apparatus for dispersing materials according to claim 6, wherein the second means for introducing a fluid into said conduit means is an injector.

8. An apparatus for dispersing materials according to claim 6, wherein the second means for introducing a fluid into a conduit means is an orifice at the wall of the conduit means.

9. An apparatus for dispersing materials according to claim 6, wherein the third means is an injector defined by a stem and an orifice.

10. An apparatus for dispersing materials according to claim 6, wherein the third means is a member positioned in the flowpath of the slurry.

11. A distributor for viscous, hydraulic slurries comprising:

a main conduit located on a first axis for conducting a flowing, viscous, hydraulic slurry toward an orifice from which it is dispersed by air pressure;

fluid conductor means located on a second axis intersecting the main conduit directed toward the orifice;

a first means located on a third axis and intersecting the main conduit;

the first means being located upstream from the orifice, relative to the direction of flow, for introducing low viscosity liquid into the flowing slurry before the dispersing air has been introduced, such that the low viscosity liquid impinges on fluid conductor means before dispersion.

12. A distributor for distributing a low viscosity fluid into viscous, hydraulic slurries according to claim 11, wherein the fluid conductor means is an air stem.

13. A distributor for distributing a low viscosity fluid into viscous, hydraulic slurries according to claim 11, wherein the fluid conductor means is a member positioned in the flowpath of the slurry.

14. A distributor for distributing a low viscosity fluid into viscous, hydraulic slurries according to claim 11, wherein the second and third axes are substantially co-planar with each other and the first axis.

15. A distributor for distributing a low viscosity fluid into viscous, hydraulic slurries according to claim 11, wherein the second and third axes are co-planar with each other and the first axis.

16. A distributor for distributing a low viscosity fluid into viscous, hydraulic slurries comprising:

a main conduit located on a first axis for conducting a flowing, viscous, hydraulic slurry toward an orifice;

an air injector defined by a stem located on a second axis intersecting the main conduit and an orifice for introducing air to the slurry to disperse it from the orifice;

a second injector located on a third axis and intersecting the main conduit;

the second injector being located upstream from the orifice, relative to the direction of flow, for introducing low viscosity fluid into the flowing slurry before the dispersing air has been introduced, such that the low viscosity fluid impinges on the air injector stem before dispersion.

17. A distributor according to claim 16, wherein the second and third axes are substantially co-planar with each other and the first axis.

18. A distributor according to claim 16, wherein the second and third axes are co-planar with each other and the first axis.

19. A distributor according to claim 16, wherein the third axis intersects the second axis.

20. A distributor according to claim 16, wherein the third axis is aligned towards the second axis.

21. A distributor according to claim 16, wherein the viscous, hydraulic slurry is cementitious.

22. A distributor according to claim 16, wherein the low viscosity fluid is an accelerator.

23. A distributor according to claim 16, wherein the accelerator is aluminum sulfate.

24. A method for distributing a low viscosity fluid into viscous, hydraulic slurries, comprising:

directing a viscous, hydraulic, slurry along a flow path to a distribution point;

introducing air to the flow path through an air injector stem which intersects the flow path; and introducing a low viscosity liquid into the flow path directed along an axis which intersects the flow path and impinges the low viscosity liquid onto the injector stem before the slurry reaches the distribution point.

25. A method for distributing a low viscosity fluid into a viscous hydraulic slurry, according to claim 24, wherein the slurry is cementitious.

26. A method for distributing a low viscosity fluid into a viscous hydraulic slurry, according to claim 24, wherein the low viscosity liquid is an accelerator.

27. A method for distributing a low viscosity fluid into a viscous hydraulic slurry according to claim 26, wherein the accelerator is aluminum sulfate.

28. A distributor for distributing low viscosity fluids into viscous hydraulic slurries, comprising:

a main conduit located on a first axis for conducting a flowing viscous, hydraulic, slurry toward an orifice;

an air injector defined by a stem located on a second axis, which air injector stem intersects the main conduit for introducing air to the flowing slurry to disperse it from the orifice;

a second injector located on a third axis and intersecting the main conduit;

the second injector being located upstream from the air injector stream, relative to the direction of flow, for introducing low viscosity liquid into the flowing slurry before dispersing air has been introduced; and the second axis and the third axis being substantially coplanar with each other and the first axis.

29. A distributor according to claim 28, wherein the second and third axes are co-planar with each other and the first axis.

30. A distributor according to claim 28, wherein the viscous, hydraulic slurry is cementitious.

31. A distributor according to claim 28, wherein the low viscosity liquid is an accelerator.

32. A distributor according to claim 28, wherein the accelerator is aluminum sulfate.

33. A method for distributing low viscosity fluids into viscous, hydraulic slurries in dispersed form, comprising:

directing a viscous, hydraulic, slurry along a flow path located on a first axis to a distribution point;

introducing air into the flow path through an air injector stem located on a second axis, which air injector stem intersects the flow path;

introducing a low viscosity liquid into the flow path directed along a third axis which is substantially co-planar with the second axis and the first axis such that upon the introduction of air, the slurry departs from the distribution point in dispersed form.

34. A method according to claim 33, wherein the second and third axes are co-planar with each other and the first axis.

35. A method for distributing low viscosity fluids into viscous, hydraulic slurries according to claim 33, wherein the viscous, hydraulic slurry is cementitious.

36. A method for distributing low viscosity fluids into viscous, hydraulic slurries according to claim 33, wherein the low viscosity liquid is an accelerator.

37. A method for distributing low viscosity fluids into viscous, hydraulic slurries according to claim 33, wherein the accelerator is aluminum sulfate.

* * * * *